US007987536B1

(12) United States Patent
Habig et al.

(10) Patent No.: US 7,987,536 B1
(45) Date of Patent: Aug. 2, 2011

(54) ANIMAL-THEMED SLEEP SYSTEM

(75) Inventors: Michael M. Habig, Minneapolis, MN (US); Mari L. Anderson, Minneapolis, MN (US); Elizabeth C. Kern, Minneapolis, MN (US); Adam D. Hoppus, Minneapolis, MN (US); Keegan L. Garvey, Minneapolis, MN (US)

(73) Assignee: Target Brands, Inc., Minneapolis, MN (US)

( * ) Notice: Subject to any disclaimer, the term of this patent is extended or adjusted under 35 U.S.C. 154(b) by 0 days.

(21) Appl. No.: 12/912,250

(22) Filed: Oct. 26, 2010

(51) Int. Cl.
*A47G 9/04* (2006.01)

(52) U.S. Cl. ..... 5/413 R; 5/907

(58) Field of Classification Search ..... 5/413 R, 5/413 AM, 414, 907; 2/69.5; 135/96
See application file for complete search history.

(56) References Cited

U.S. PATENT DOCUMENTS

| | | | | |
|---|---|---|---|---|
| 1,575,263 | A | 3/1926 | Guglielmi | |
| D174,238 | S | 3/1955 | Stevens | |
| 3,579,675 | A | 5/1971 | Scheer | |
| D255,525 | S | 6/1980 | Roberts | |
| 4,458,372 | A | 7/1984 | Mills | |
| 4,590,633 | A | 5/1986 | Pickens | |
| 4,614,505 | A | 9/1986 | Schneider et al. | |
| D289,820 | S | 5/1987 | Paik et al. | |
| 4,754,512 | A | 7/1988 | Chao-Yang | |
| 4,774,734 | A | 10/1988 | Mills | |
| 4,856,131 | A | 8/1989 | Mills | |
| 5,084,930 | A | 2/1992 | Danova | |
| 5,172,440 | A | 12/1992 | Ming | |
| 5,421,045 | A | 6/1995 | Bowen | |
| D365,915 | S | 1/1996 | Merkley et al. | |
| 5,515,559 | A | 5/1996 | Benson | |
| D399,988 | S | 10/1998 | Frank | |
| D409,429 | S | 5/1999 | Bear | |
| D414,366 | S | 9/1999 | Harwich | |
| 6,343,968 | B1 * | 2/2002 | Louie et al. | 446/72 |
| 6,421,852 | B1 | 7/2002 | Shao | |
| 6,425,795 | B1 | 7/2002 | Horsfall et al. | |
| 6,543,072 | B2 | 4/2003 | Hsu | |
| 7,181,785 | B2 | 2/2007 | Dinan et al. | |
| 7,383,598 | B2 | 6/2008 | Titcomb | |
| D595,985 | S * | 7/2009 | Su | D6/595 |
| 2007/0180615 | A1 * | 8/2007 | Yang | 5/414 |
| 2010/0178837 | A1 | 7/2010 | Daniels | |

* cited by examiner

*Primary Examiner* — Fredrick Conley
(74) *Attorney, Agent, or Firm* — Nixon & Vanderhye P.C.

(57) ABSTRACT

A sleep system includes a sack and a sleeping bag. The sack includes an exterior surface, an interior surface, a closed end and an open end. The exterior surface of the closed end includes decorative features of an animal head. The sleeping bag is configured to be stored in the sack when not in use. The sleeping bag includes a fastener that detachably connects at least two edges of the sleeping bag and has a fastener pull. The fastener pull includes an animal tail corresponding with the animal head located on the exterior surface of the closed end of the sack.

17 Claims, 9 Drawing Sheets

ANIMAL-THEMED SLEEP SYSTEM

BACKGROUND

A sleeping bag includes a protective blanket folded in half for providing warmth. A fastening mechanism, such as a zipper, is located along select free edges of the blanket to allow each half of the blanket to be secured together. In this configuration, the sleeping bag functions as bedding in situations where it is not possible to sleep in a bed. For example, sleeping bags are useful for camping or to make floor sleeping more comfortable.

In some instances, a sleeping bag is secured into a storage state with ties. In other instances, a sleeping bag is secured into its storage state by stuffing, folding or rolling the sleeping bag into a storage sack.

The discussion above is merely provided for general background information and is not intended to be used as an aid in determining the scope of the claimed subject matter.

SUMMARY

A sleep system includes a sack and a sleeping bag. The sack has an exterior surface, an interior surface, a closed end and an open end. The exterior surface of the closed end includes decorative features of an animal head. The sleeping bag is configured to be stored in the sack when not in use. A fastener detachably connects at least two free edges of the sleeping bag. The fastener includes a fastener pull configured to connect and disconnect the at least two free edges. The fastener pull includes an animal tail corresponding with the animal head located on the exterior surface of the closed end of the sack.

To store the sleeping bag, the sleeping bag is inserted into the sack. The animal tail of the fastener pull is pulled through the open end of the sack. The open end of the sack includes an edge having a drawcord tunnel which houses a drawcord. Using the drawcord, the open end of the sack is cinched together until it is at least partially closed. The animal tail, which was pulled through the open end of the sack, extends outwardly from the exterior surface of the sack.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter. The claimed subject matter is not limited to implementations that solve any or all disadvantages noted in the background.

DETAILED DESCRIPTION OF ILLUSTRATIVE EMBODIMENTS

Embodiments are described as a sleep system including a sleeping bag and a sack for holding the sleeping bag during storage and transport. The sack includes a closed end and an open end. The open end is securable into an at least partially closed configuration with a drawstring, while the substantially circular closed end is decorated with features of an animal head. The sleeping bag includes a fastener having a fastener pull that includes an animal-shaped tail. The animal-shaped tail matches the animal head on the closed end of the sack. When the sleeping bag is stuffed, rolled or folded and located in the sack, the animal-shaped tail is pulled through the open end and extends outwardly from the sack. In its stored state, the sleep system resembles the body of an animal.

Figure 9:
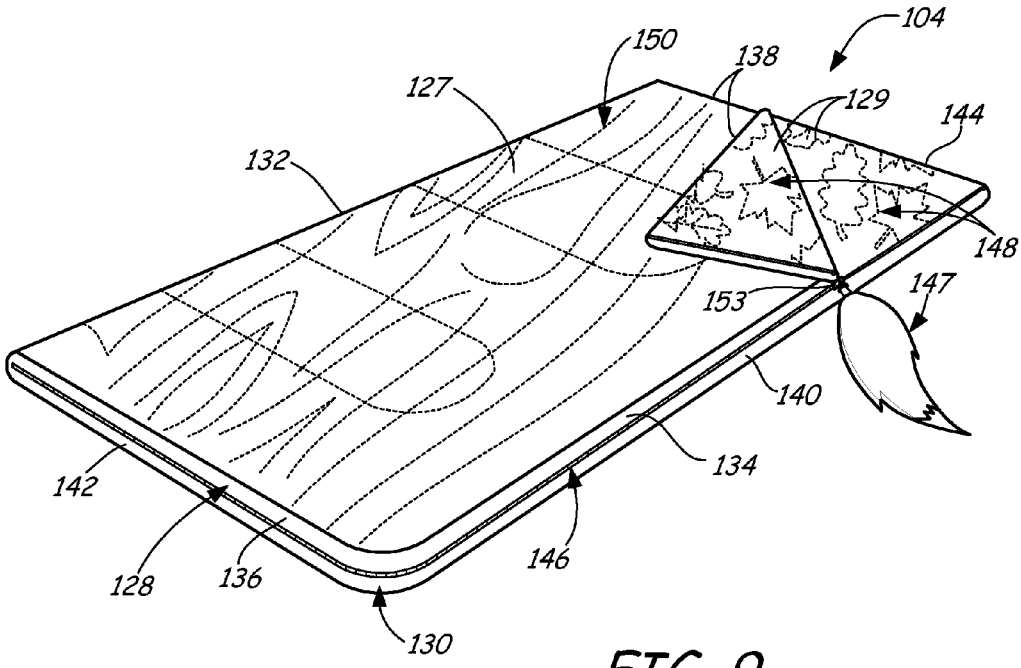
FIG. 9 is a perspective view of a sleeping bag of the sleep system illustrated in FIGS. 1-8.

FIGS. 1-8 illustrate various views of a sleep system 100 under one embodiment. Sleep system 100 includes a sleeping bag (not shown in FIGS. 1-8) and a sack 102 for retaining or holding the sleeping bag during storage and transport. In FIGS. 1-8, the sleeping bag is located within and covered by sack 102 and therefore is hidden from view. However, sleeping bag 104 is illustrated in FIG. 9 in a perspective view.

Figure 1:
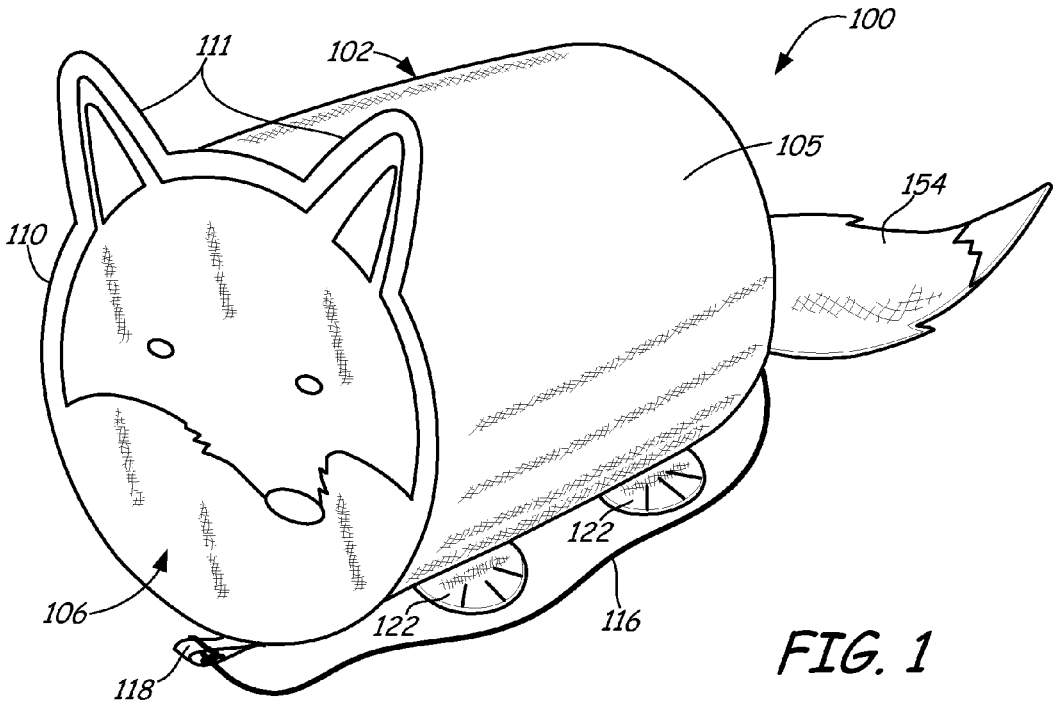
FIG. 1 illustrates a front perspective view of a sleep system under one embodiment.
Figure 5:
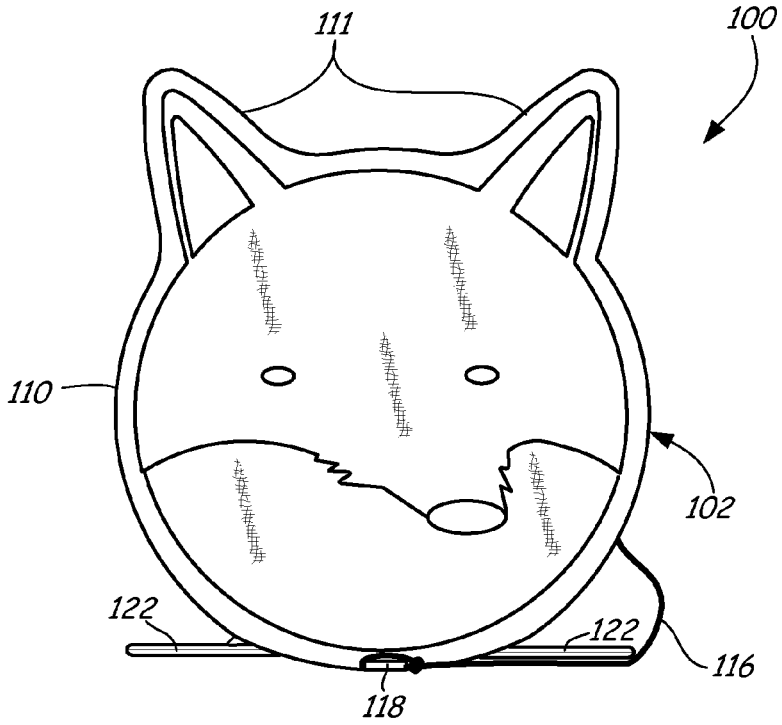
FIG. 5 illustrates a front view of the sleep system of FIG. 1.

Sack 102 comprises a pliable material made of, for example, polyester and includes an interior surface (not illustrated), an exterior surface 105, a first or closed end 106 and a second or open end 108. The exterior surface 105 of first or closed end 106 includes decorative features of an animal head. More specifically and as shown in FIGS. 1 and 5, exterior surface 105 of first end 106 includes decorative features of a fox head. It should be realized that the terminology "animal head" does not mean that exterior surface 105 of first end 106 includes features of a real animal head. Rather, "animal head" contemplates ornamental or decorative features that simulate characteristics of an animal head.

First or closed end 106 has a substantially circular perimeter 110, for example. Portions of the decorative features of the fox head are located both within the perimeter 110 as well as outside the perimeter 110 and can be both part of the material of the sack and/or printed or heat embossed onto the exterior surface 105 of the material of the sack. While portions of the decorative features of the fox head, such as the nose and the eyes, are located within the perimeter 110 of first end 106 and are printed or heat embossed on the exterior surface 105, other portions are coupled to first end 106 and extend outwardly from the perimeter 110. For example and as illustrated in FIGS. 1, 2 and 5-8, portions of the animal ears 111 of the fox are coupled to first end 106 and extend outwardly from perimeter 110. It should be realized that the terminology "animal ears" does not mean that decorative features coupled to first end 106 include features of a real animal ears. Rather, "animal ears" contemplates ornamental or decorative features that simulate characteristics of animal ears.

Second end 108 includes an opening 112 having an edge with a drawcord tunnel 114. Drawcord tunnel 114 houses at least a portion of a drawcord 116 such that opening 112 can be cinched closed into a smaller opening or cinched together such that second end 108 is at least partially closed. As illustrated more clearly in FIG. 4, drawcord 116 is tied to a loop 118 at one end and secured through drawcord tunnel 114 with a cord lock 120. Cord lock 120 attaches to drawcord 116 so that the portion of the drawcord threaded or passed through drawcord tunnel 114 allows exposed drawcord 116 to be shortened to enlarge opening 112 or allows exposed drawcord 116 to be lengthened to cinch opening 112.

Sack 102 also includes a plurality of decorative feet 122 coupled to the exterior surface 105 of the sack 102. Each decorative foot is attached to the exterior surface 105 at a location between first or closed end 106 and second or open end 108 by, for example, a line of stitching 126 (FIG. 4) such that feet 122 extend from and protrude from exterior surface 105 of sack 102. Decorative feet 122 are located on the bottom of sack 102 as illustrated in the FIG. 4 bottom view. The bottom of sack 102 is the relative bottom in light of the orientation of the printed or heat embossed and/or material features of the animal or fox head.

With reference to FIG. 9, sleeping bag 104 includes a blanket material for providing insulating properties to a person sleeping inside the sleeping bag. For example, the blanket material can include sheeting having a filling. The blanket material includes an exterior surface 127 and an interior surface 129 and is folded at fold 132 such that half of the material including exterior and interior surfaces 127 and 129 form a cover 128 and the other half of the material including exterior and interior surfaces 127 and 129 form a back 130. Cover 128 is defined by fold 132 and a plurality of free edges including a side edge 134 opposing the fold 132, a bottom edge 136 and a top edge 138. Bottom 130 is defined by fold 132 and a plurality of free edges including a side edge 140 opposing the fold 132, a bottom edge 142 and a top edge 144.

Sleeping bag 104 includes a fastener 146 for detachably connecting at least one of the free edges of both cover 128 and back 130 to form a bag structure for a person to lie in. In FIG. 9, a first portion of fastener 146 is located along side edge 134 and bottom edge 136 and a second portion of fastener 146 is located along side edge 140 and bottom edge 142. Fastener 146 also includes a slide 153 and fastener pull 147 coupled to the slide 153. For example and as illustrated in FIG. 9, fastener 146 can be a zipper 146 having slide 153 and zipper pull 147. In such an embodiment, first portion of fastener 146 is a row of a plurality of first teeth and the second portion of fastener 146 is a row of a plurality of second teeth. Slide 153 moves along the rows of teeth and meshes together or separates the opposing rows of teeth depending on the direction slide 153 is moved.

While the interior and exterior surfaces 127 and 129 of sleeping bag 104 can be made of the same or different material, sleeping bag 104 may, but not always include a first type of pattern on the interior of the sleeping bag and a second type of pattern on the exterior of the sleeping bag. For example and as illustrated in FIG. 9, the interior surface 129 of sleeping bag 104 includes a printed first design 148 and the exterior surface 127 of the sleeping bag 104 includes a heat embossed second design 150. In particular, first design 148 includes a printed leaf design and second design 150 includes a heat embossed wood grain design.

Figure 10:
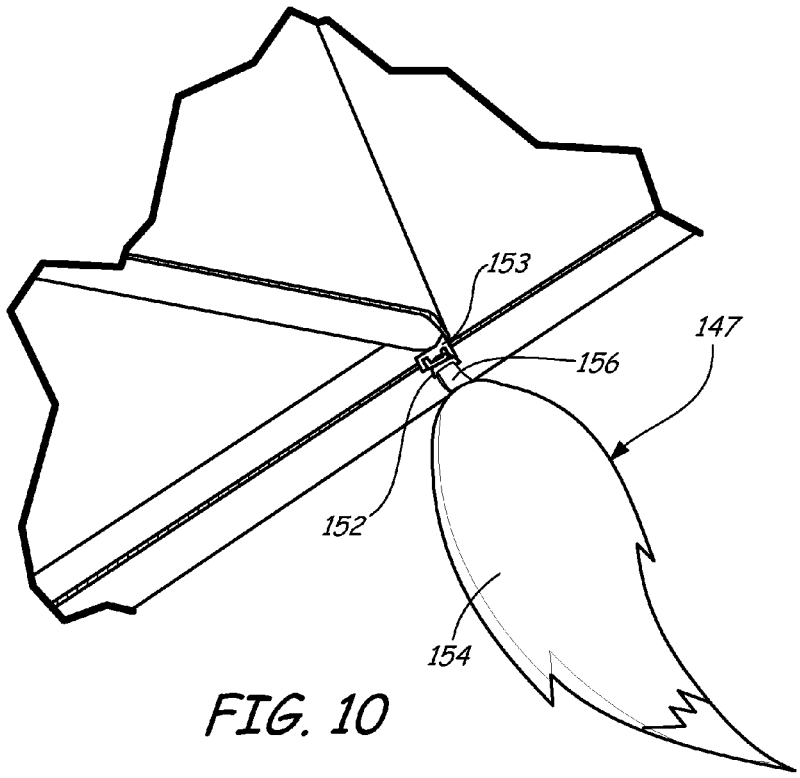
FIG. 10 is an enlarged view of a zipper pull on the sleeping bag illustrated in FIG. 9.

FIG. 10 illustrates an enlarged detailed view of fastener pull 147 under one embodiment. Fastener pull 147 includes a ring portion 152 attached to slide 153 and a pull portion 154 attached to ring portion 152. A tab portion 156 is connected to pull portion 154, passes through the center of ring portion 152 and is stitched together so as to form a closed loop around ring portion 152. Pull portion 154 is in the form of an animal tail that corresponds to and/or matches the decorative animal head on the exterior surface 105 of first end 106 of the corresponding sack 102. For example and as illustrated in FIGS. 9 and 10, pull portion 154 is a fox tail. It should be realized that the terminology "animal tail" does not mean that pull portion 154 includes features of a real animal tail. Rather, "animal tail" contemplates an ornamental or decorative object that simulates characteristics of an animal tail. To open the sleeping bag 104 for use, the fastener 146 is unfastened by tugging on the animal tail or pull portion 154, which effectively moves slide 153 in a direction away from the top of sleeping bag 104. Likewise, to shut sleeping bag 104, the fastener 146 is fastened shut by tugging on the animal tail or pull portion 154, which effectively moves slide 153 in a direction toward the top of sleeping bag 104.

Figure 2:
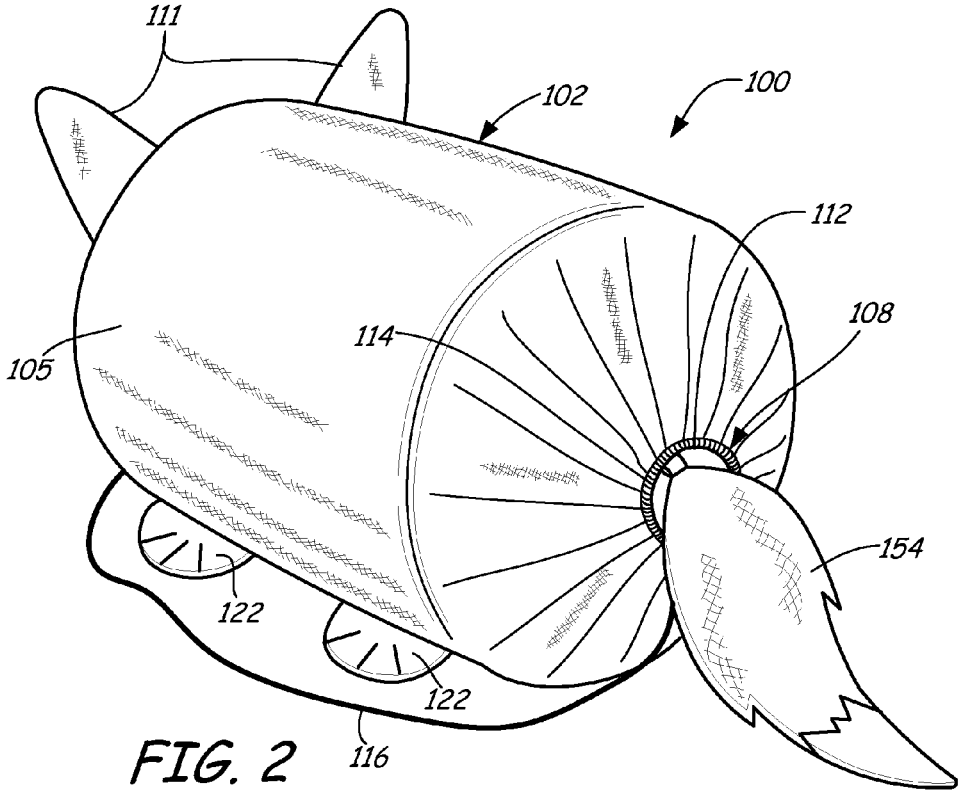
FIG. 2 illustrates a back perspective view of the sleep system of FIG. 1.
Figure 3:
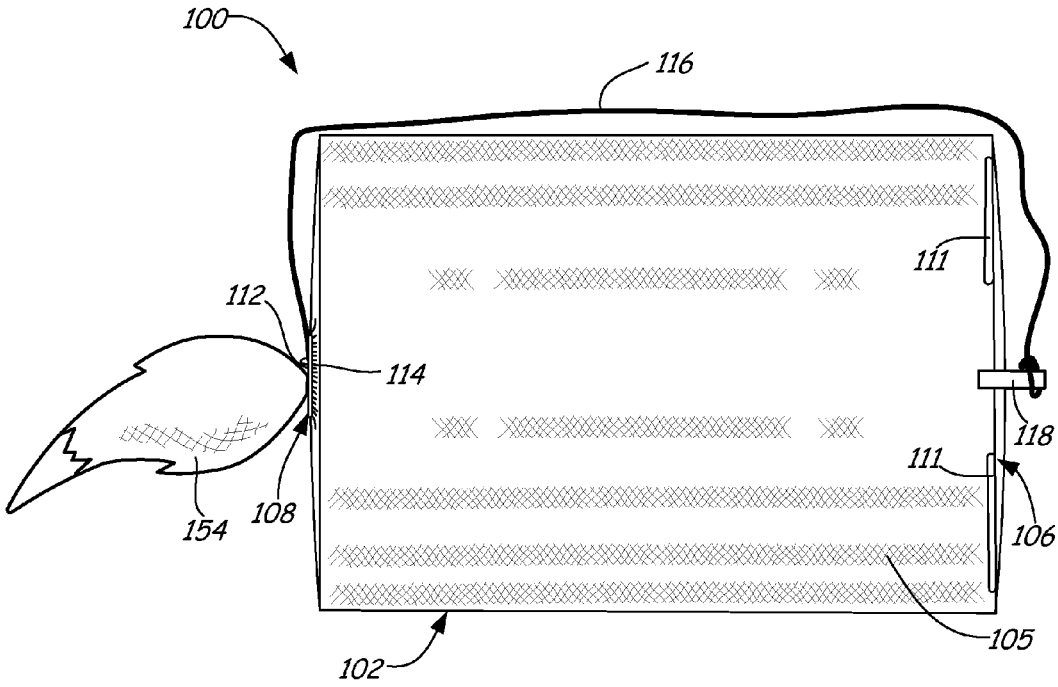
FIG. 3 illustrates a top view of the sleep system of FIG. 1.
Figure 4:
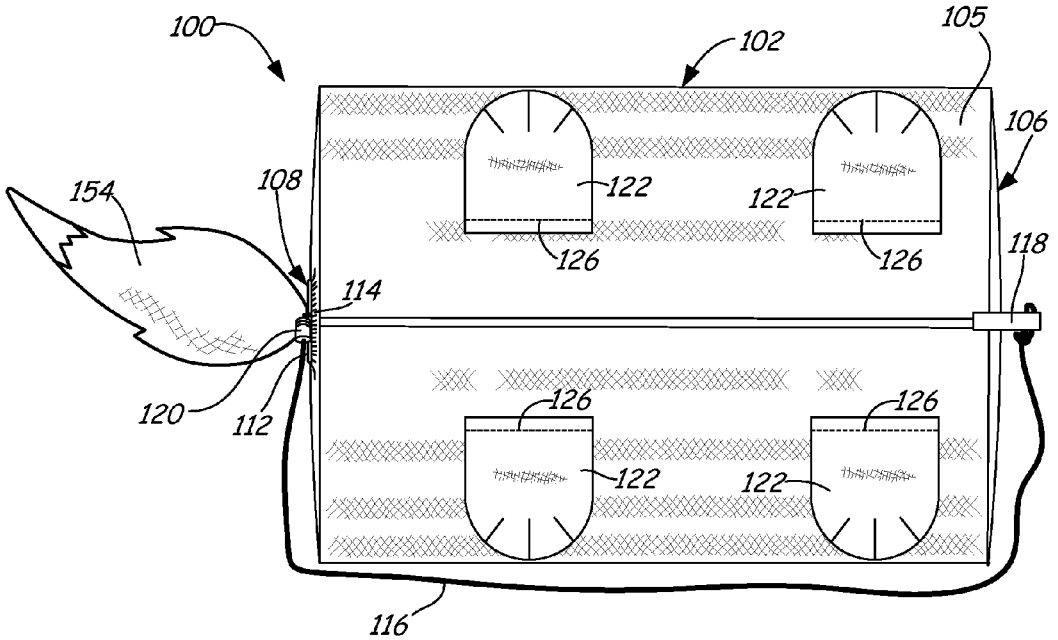
FIG. 4 illustrates a bottom view of the sleep system of FIG. 1.
Figure 6:
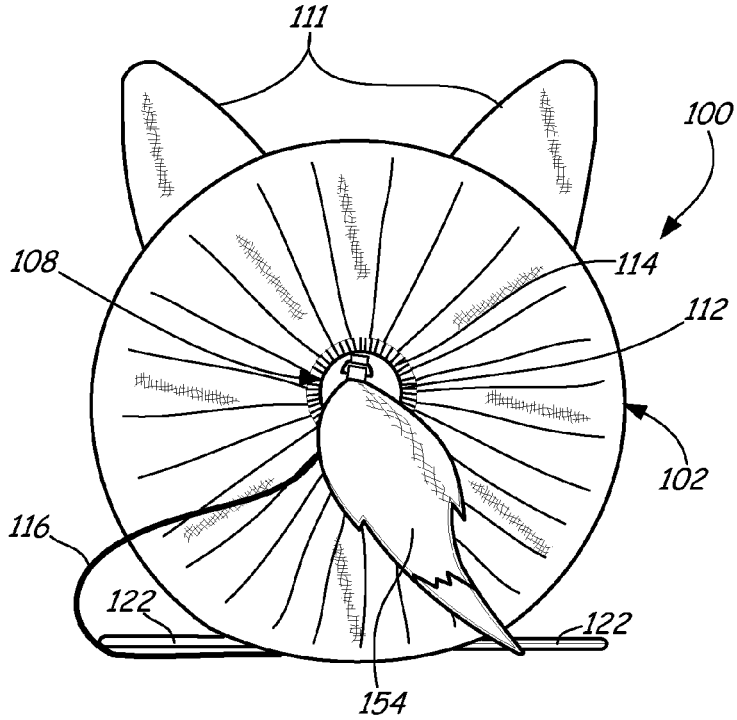
FIG. 6 illustrates a back view of the sleep system of FIG. 1.
Figure 7:
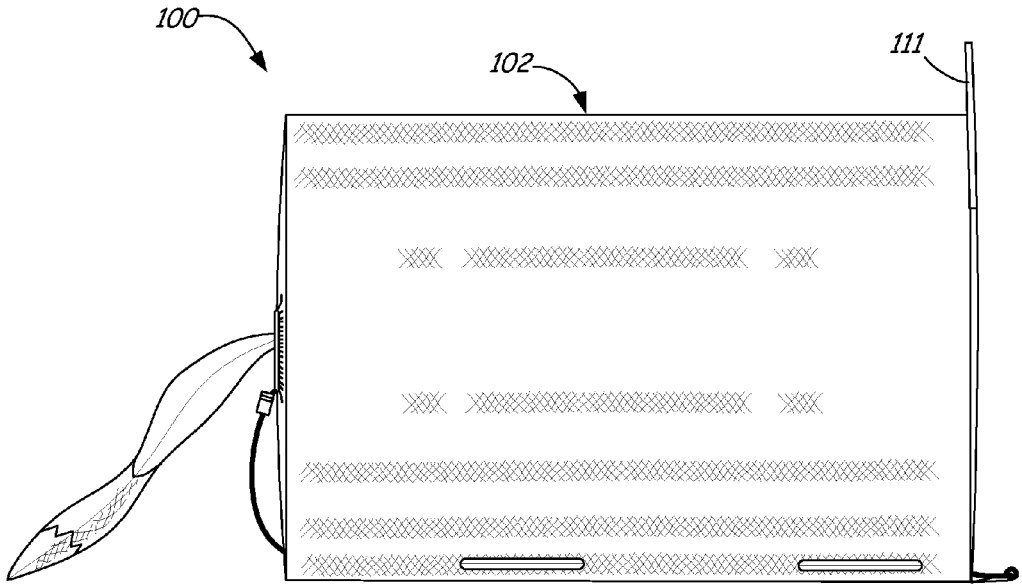
FIG. 7 illustrates a left side view of the sleep system of FIG. 1
Figure 8:
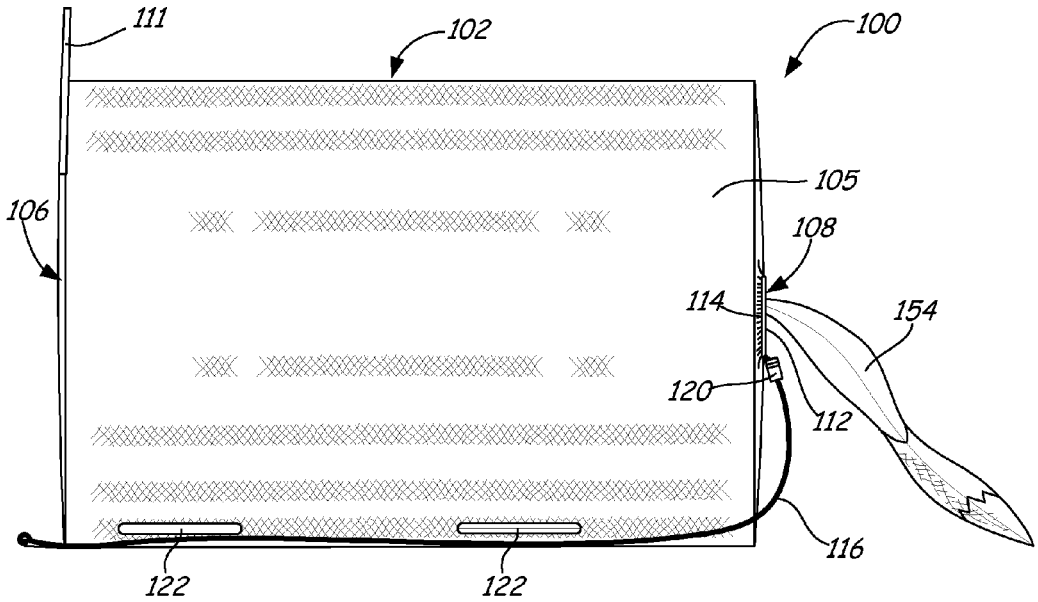
FIG. 8 illustrates a right side view of the sleep system of FIG. 1.

Sleeping bag 104 can be stuffed, rolled or folded for storing in sack 102. For example, sleep system 100 can include straps made of hook and loop, such as Velcro®, for wrapping and securing around the rolled or folded sleeping bag 104 before inserting the rolled or folded sleeping bag 104 into sack 102. Although the ring portion 152, slide 153 and pull portion 154 of fastener pull 147 are parts of sleeping bag 104, after sleeping bag 104 is stuffed, rolled or folded and placed into sack 102 for storage as illustrated in FIGS. 1-8, the animal tail 154 is pulled through opening 112 to extend outwardly from sack 102. When drawcord 116 is tightened as illustrated in FIGS. 2 and 6, animal tail 154 remains extended from exterior surface 105 of sack 102 such that the sack holding the sleeping bag resembles the body and shape of an animal.

Figure 11:
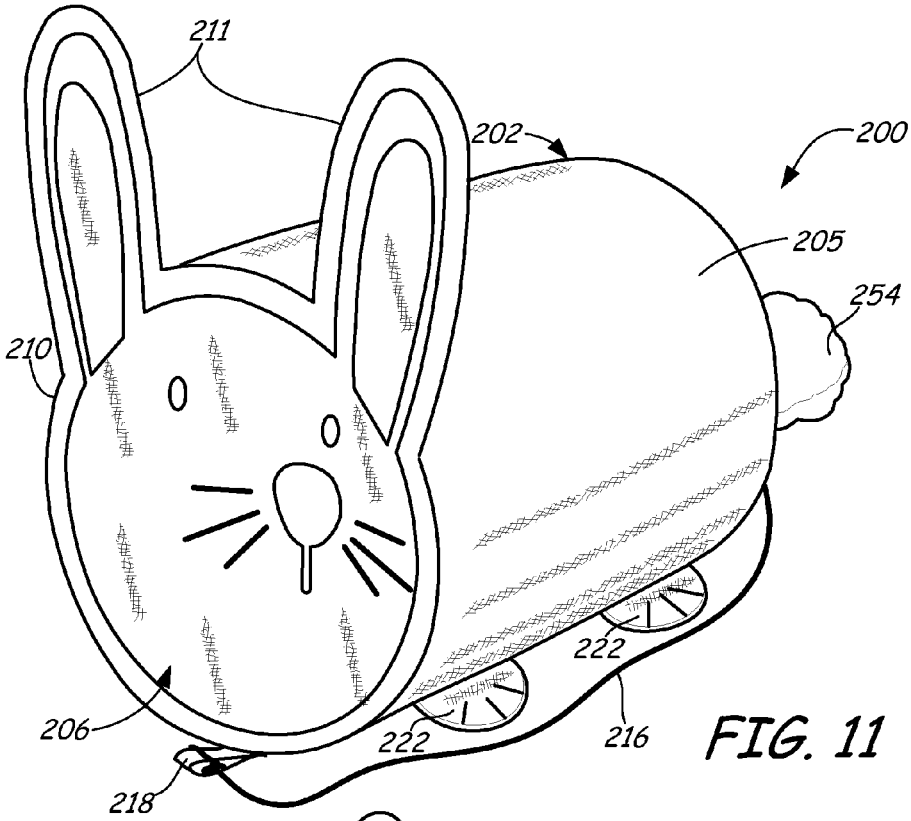
FIG. 11 illustrates a front perspective view of a sleep system under another embodiment.
Figure 12:
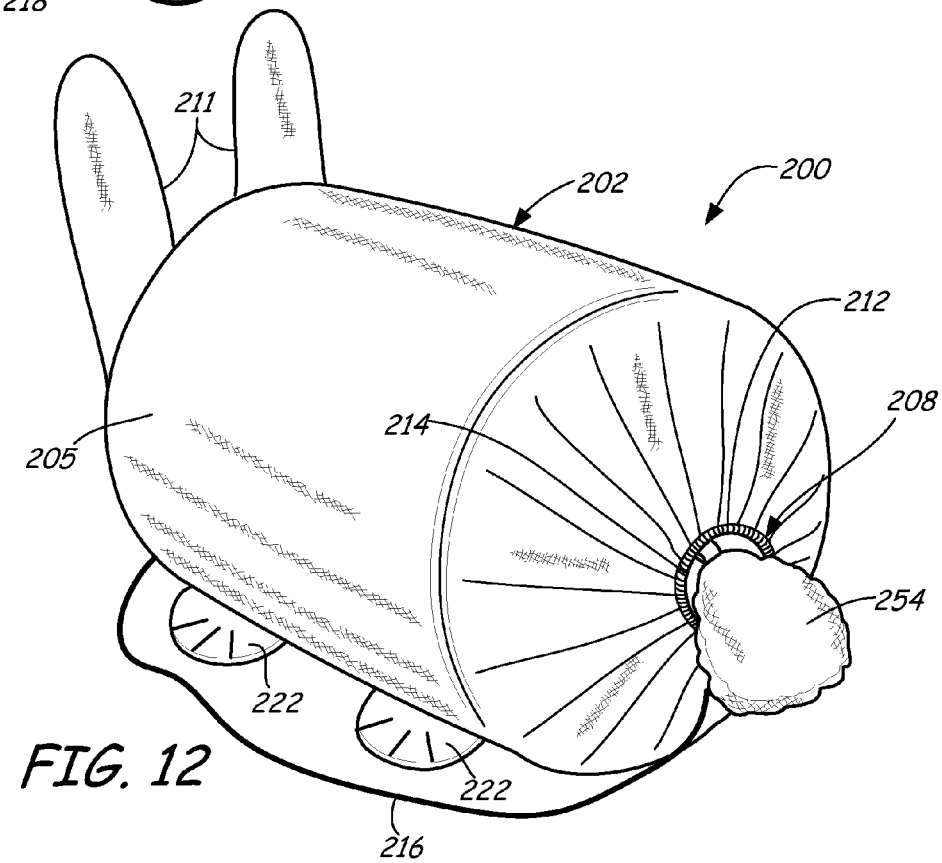
FIG. 12 illustrates a back perspective view of the sleep system of FIG. 11.
Figure 13:
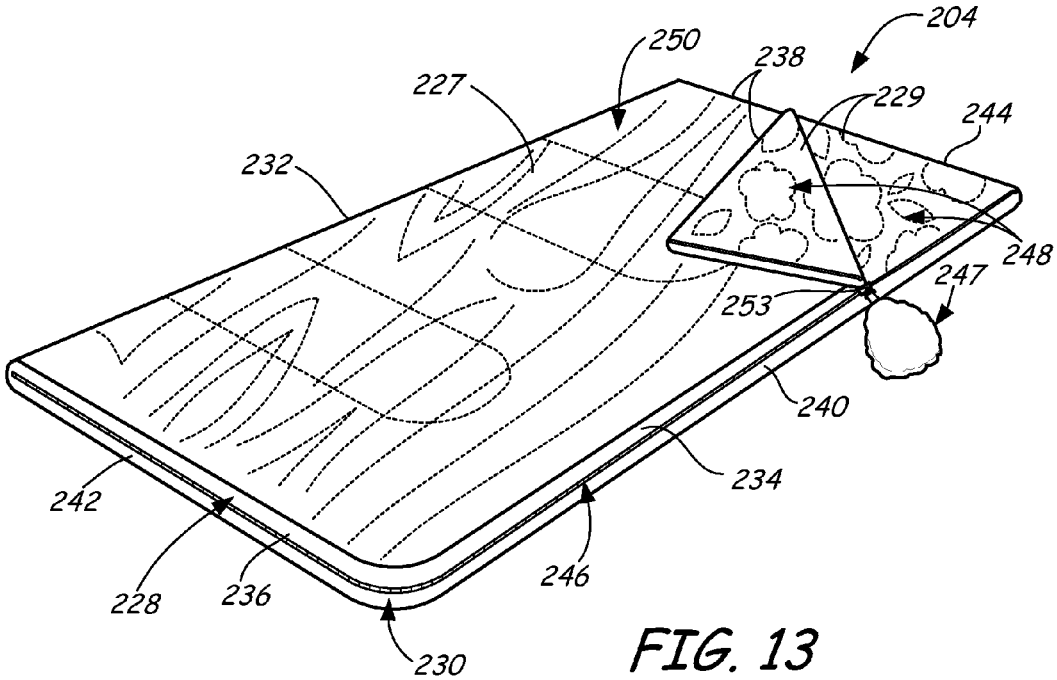
FIG. 13 illustrates a perspective view of a sleeping bag of the sleep system illustrated in FIGS. 11 and 12.

FIGS. 11 and 12 illustrate front and back perspective views of a sleep system 200 under another embodiment. Sleep system 200 includes a sleeping bag (not shown in FIGS. 11 and 12) and a sack 202 for retaining or holding the sleeping bag during storage and transport. As discussed below, sleep system 200 is similar to sleep system 100. However, rather than sleep system 200 including a fox head and fox tail, sleep system 200 includes a rabbit head and corresponding rabbit tail. In FIGS. 11 and 12, the sleeping bag is located within and covered by sack 202 and therefore is hidden from view. However, sleeping bag 204 is illustrated in FIG. 13 in a perspective view.

Sack 202 comprises a pliable material made of, for example, polyester and includes an interior surface (not illustrated), an exterior surface 205, a first or closed end 206 and a second or open end 208. The exterior surface 205 of first end 206 includes decorative features of an animal head. More specifically and as shown in FIG. 11, exterior surface 205 of first end 206 includes decorative features of a rabbit head. It should be realized that the terminology "animal head" does not mean that exterior surface 205 of first end 206 includes features of a real animal head. Rather, "animal head" contemplates ornamental or decorative features that simulate characteristics of an animal head.

First or closed end 206 has a substantially circular perimeter 210, for example. Portions of the decorative features of the rabbit head are located both within the perimeter 210 as well as outside the perimeter 210 and can be both part of the material of the sack and/or printed or heat embossed onto the exterior surface 205 of the material of the sack. While portions of the decorative features of the rabbit head, such as the nose and the eyes, are located within the perimeter 210 of first end 206 and are printed or heat embossed on the exterior surface 205, other portions are coupled to first end 206 and extend outwardly from the perimeter 210. For example and as illustrated in FIGS. 11 and 12, portions of the animal ears 211 of the rabbit are coupled to first end 206 and extend outwardly from perimeter 210. It should be realized that the terminology "animal ears" does not mean that decorative features coupled to first end 206 include features of a real animal ears. Rather, "animal ears" contemplates ornamental or decorative features that simulate characteristics of animal ears.

Second end 208 includes an opening 212 having an edge with a drawcord tunnel 214. Drawcord tunnel 214 houses at least a portion of a drawcord 216 such that opening 212 can be cinched closed into a smaller opening or cinched together such that second end 208 is at least partially closed. As illustrated more clearly in FIG. 11, drawcord 216 is tied to a loop 218 at one end and secured through drawcord tunnel 214 with a cord lock (illustrated in FIGS. 4 and 7-8 of the fox embodiment). The cord lock attaches to drawcord 216 so that the portion of the drawcord threaded or passed through drawcord tunnel 214 allows exposed drawcord 216 to be shortened to enlarge opening 212 or allows exposed drawcord 216 to be lengthened to cinch opening 212.

Sack 202 also includes a plurality of decorative feet 222 coupled to exterior surface 205 of sack 202. Each decorative foot is attached to exterior surface 205 of sack 202 at a location between first or closed end 206 and second or open end 208 by, for example, a line of stitching (illustrated in FIG. 4 of the fox embodiment) such that feet 222 extend from and protrude from exterior surface 205 of sack 202. Decorative feet 222 are located on the bottom of sack 202 as illustrated in FIGS. 11 and 12. The bottom of sack 202 is the relative bottom in light of the orientation of the printed or heat embossed and/or material features of the rabbit head.

With reference to FIG. 13, sleeping bag 204 includes a blanket material for providing insulating properties to a person sleeping inside the sleeping bag. For example, the blanket material can include sheeting having a filling. The blanket material includes an exterior surface 227 and an interior surface 229 and is folded at fold 232 such that half of the material including exterior and interior surfaces 227 and 229 form a cover 228 and the other half of the material including exterior and interior surfaces 227 and 229 form a back 230. Cover 228 is defined by fold 232 and a plurality of free edges including a side edge 234 opposing the fold 232, a bottom edge 236 and a top edge 238. Bottom 230 is defined by fold 232 and a plurality of free edges including a side edge 240 opposing the fold 232, a bottom edge 242 and a top edge 244.

Sleeping bag 204 includes a fastener 246 for detachably connecting at least one of the free edges of both cover 228 and back 230 to form a bag structure for a person to lie in. In FIG. 13, a first portion of fastener 246 is located along side edge 234 and bottom edge 236 and a second portion of fastener 246 is located along side edge 240 and bottom edge 242. Fastener 246 also includes a slide 253 and fastener pull 247 coupled to the slide 253. For example and as illustrated in FIG. 13, fastener 246 can be a zipper 246 having a zipper pull 247. In such an embodiment, first portion of fastener 246 is a row of a plurality of first teeth and the second portion of fastener 246 is a row of a plurality of second teeth. Slide 253 moves along the rows of teeth and meshes together or separates the opposing rows of teeth depending on the direction slide 253 is moved.

While the interior and exterior surfaces 227 and 229 of sleeping bag 204 can be made of the same or different material, sleeping bag 204 may, but not always include a first type of pattern on the interior of the sleeping bag and a second type of pattern on the exterior of the sleeping bag. For example and as illustrated in FIG. 13, the interior of sleeping bag 204 includes a printed first design 248 and the exterior of the sleeping bag 204 includes a heat embossed second design 250. In particular, first design 248 includes a printed flower design and second design 250 includes a heat embossed wood grain design.

Figure 14:
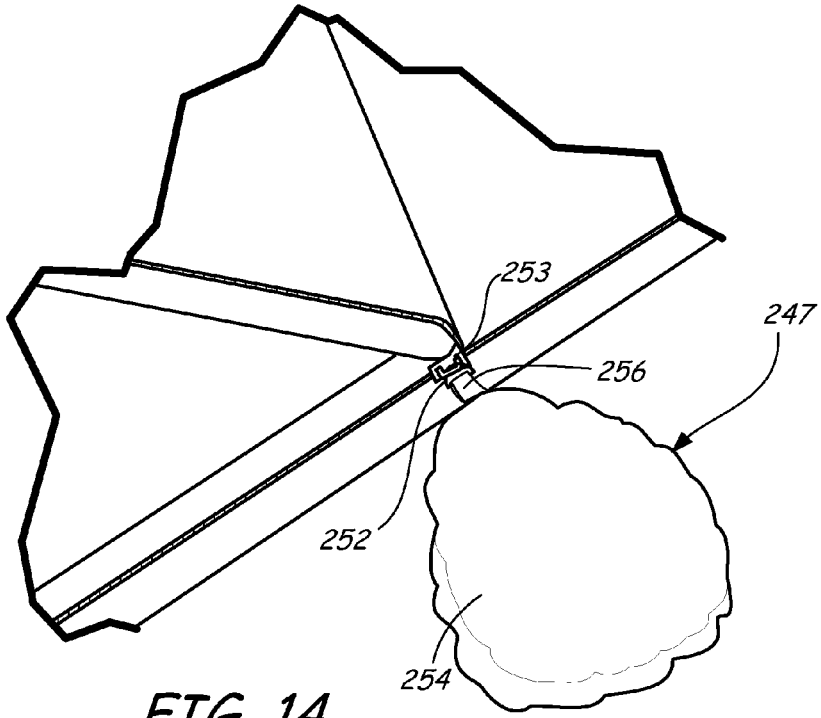
FIG. 14 is an enlarged view of a zipper pull on the sleeping bag illustrated in FIG. 13.

FIG. 14 illustrates an enlarged detailed view of fastener pull 247 under one embodiment. Fastener pull 247 includes a ring portion 252 attached to slide 253 and a pull portion 254 attached to ring portion 252. A tab portion 256 is connected to pull portion 254, passes through the center of ring portion 252 and is stitched together so as to form a closed loop around ring portion 252. Pull portion 254 is in the form of an animal tail that corresponds to and/or matches the decorative animal head on the exterior surface 205 of first end 206 of the corresponding sack 202. For example and as illustrated in FIGS. 11 and 12, pull portion 254 is a rabbit tail. It should be realized that the terminology "animal tail" does not mean that pull portion 254 includes features of a real animal tail. Rather, "animal tail" contemplates an ornamental or decorative object that simulates characteristics of an animal tail. To open the sleeping bag 204 for use, the fastener 246 is unfastened by tugging on the animal tail or pull portion 254, which effectively moves slide 253 in a direction away from the top of sleeping bag 204. Likewise, to shut sleeping bag 204, the fastener 246 is fastened shut by tugging on the animal tail or pull portion 254, which effectively moves slide 253 in a direction toward the top of sleeping bag 204.

Sleeping bag 204 can be stuffed, rolled or folded for storing in sack 202. For example, sleep system 200 can include straps made of hook and loop, such as Velcro®, for wrapping and securing around the rolled or folded sleeping bag 204 before inserting the rolled or folded sleeping bag 204 into sack 202. Although the ring portion 252 and pull portion 254 of fastener pull 247 are parts of sleeping bag 204, after sleeping bag 204 is stuffed, rolled or folded and placed into sack 202 for storage as illustrated in FIGS. 11-12, the animal tail 254 is pulled through opening 212 to extend outwardly from sack 202. When drawcord 216 is tightened as illustrated in FIG. 12, animal tail 254 remains extended from exterior surface 205 of sack 202 such that the sack holding the sleeping bag resembles the body and shape of an animal.

Figure 15:
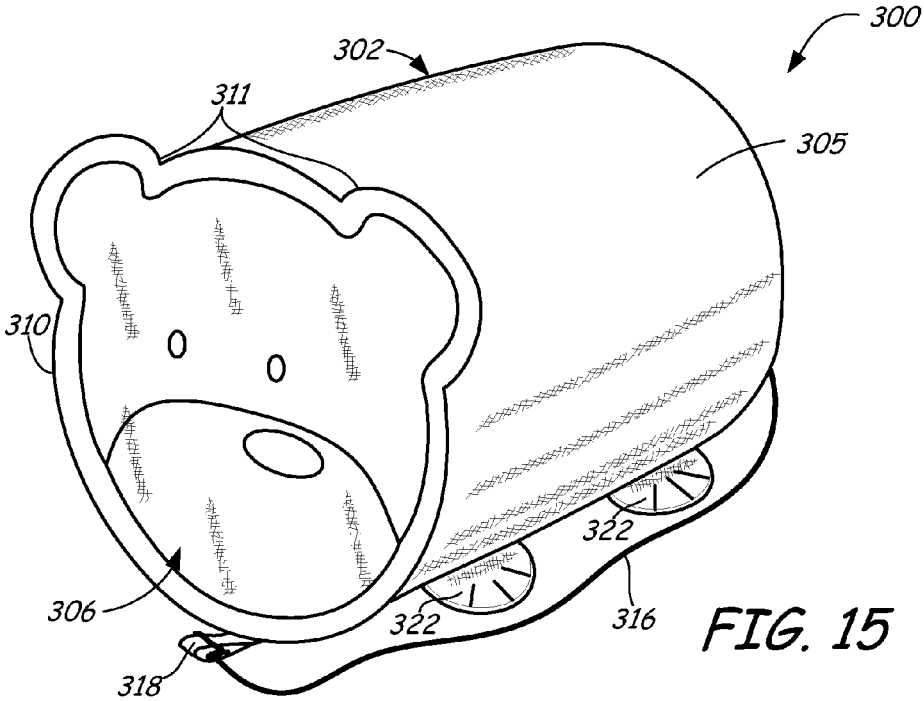
FIG. 15 illustrates a front perspective view of a sleep system under yet another embodiment.
Figure 16:
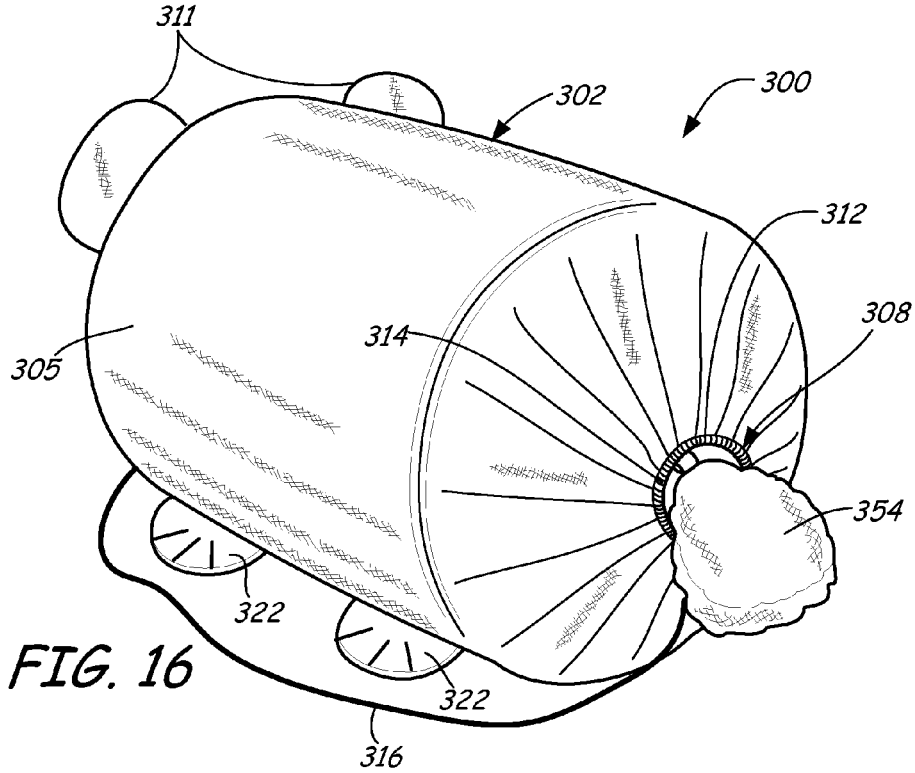
FIG. 16 illustrates a back perspective view of the sleep system of FIG. 15.
Figure 17:
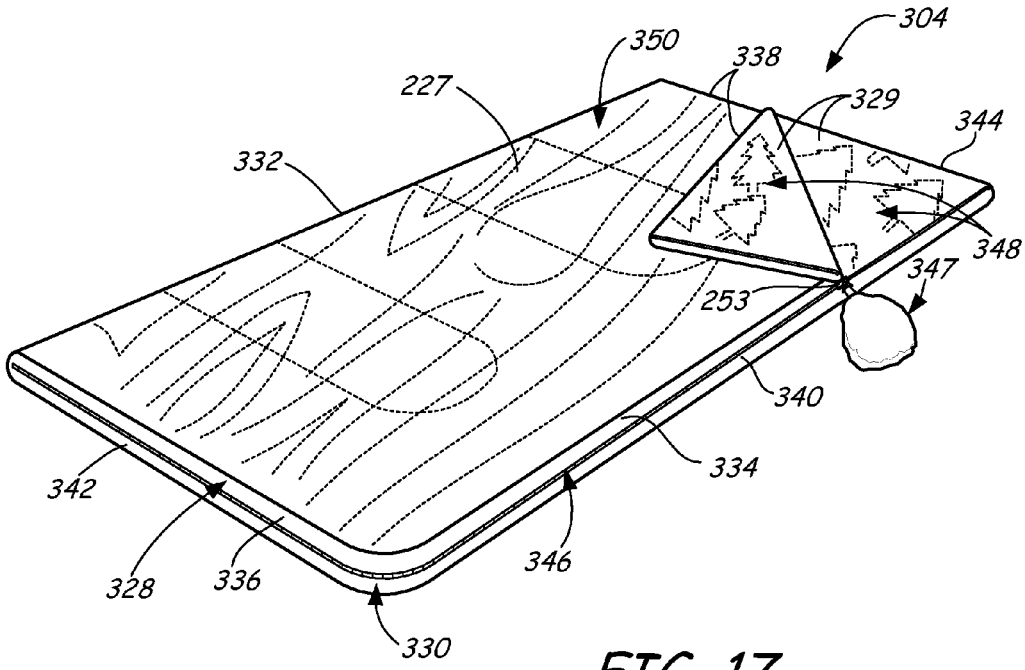
FIG. 17 illustrates a perspective view of a sleeping bag of the sleep system illustrated in FIGS. 15 and 16.

FIGS. 15 and 16 illustrate front and back perspective views of a sleep system 300 under yet another embodiment. Sleep system 300 includes a sleeping bag (not shown in FIGS. 15 and 16) and a sack 302 for retaining or holding the sleeping bag during storage and transport. As discussed below, sleep system 300 is similar to sleep systems 100 and 200. However, rather than sleep system 300 including a fox head or rabbit head and fox tail or rabbit tail, sleep system 300 includes a bear head and corresponding bear tail. In FIGS. 15 and 16, the sleeping bag is located within and covered by sack 302 and therefore is hidden from view. However, sleeping bag 304 is illustrated in FIG. 17 in a perspective view.

Sack 302 comprises a pliable material made of, for example, polyester and includes an interior surface (not illustrated), an exterior surface 305, a first or closed end 306 and a second or open end 308. The exterior surface 305 of first end 306 includes decorative features of an animal head. More specifically and as shown in FIG. 15, exterior surface 305 of first end 306 includes decorative features of a bear head. It should be realized that the terminology "animal head" does not mean that exterior surface 305 of first end 306 includes features of a real animal head. Rather, "animal head" contemplates ornamental or decorative features that simulate characteristics of an animal head.

First or closed end 306 has a substantially circular perimeter 310, for example. Portions of the decorative features of the bear head are located both within the perimeter 310 as well as outside the perimeter 310 and can be both part of the material of the sack and/or printed or heat embossed onto the exterior surface 305 of the material of the sack. While portions of the decorative features of the bear head, such as the nose and the eyes, are located within the perimeter 310 of first end 306 and are printed or heat embossed on the exterior surface 305, other portions are coupled to first end 306 and extend outwardly from the perimeter 310. For example and as illustrated in FIGS. 15 and 16, portions of the animal ears 311 of the bear are coupled to first end 306 and extend outwardly from perimeter 310. It should be realized that the terminology "animal ears" does not mean that decorative features coupled to first end 306 include features of a real animal ears. Rather, "animal ears" contemplates ornamental or decorative features that simulate characteristics of animal ears.

Second end 308 includes an opening 312 having an edge with a drawcord tunnel 314. Drawcord tunnel 314 houses at least a portion of a drawcord 316 such that opening 312 can be cinched closed into a smaller opening or cinched together such that second end 308 is at least partially closed. As illustrated more clearly in FIG. 15, drawcord 316 is tied to a loop 318 at one end and secured through drawcord tunnel 314 with a cord lock (illustrated in FIGS. 4 and 7-8 of the fox embodiment). The cord lock attaches to drawcord 316 so that the portion of the drawcord threaded or passed through drawcord tunnel 314 allows exposed drawcord 316 to be shortened to enlarge opening 312 or allows exposed drawcord 316 to be lengthened to cinch opening 312.

Sack 302 also includes a plurality of decorative feet 322 coupled to exterior surface 305 of the sack 302. Each decorative foot is attached to exterior surface 305 at a location between first or closed end 306 and second or open end 308 by, for example, a line of stitching (illustrated in FIG. 4 of the fox embodiment) such that feet 322 extend from and protrude from exterior surface 305 of sack 302. Decorative feet 322 are located on the bottom of sack 302 as illustrated in FIGS. 15 and 16. The bottom of sack 302 is the relative bottom in light of the orientation of the printed or heat embossed and/or material features of the bear head.

With reference to FIG. 17, sleeping bag 304 includes a blanket material for providing insulating properties to a person sleeping inside the sleeping bag. For example, the blanket material can include sheeting having a filling. The blanket material includes an exterior surface 327 and an interior surface 329 and is folded at a fold 332 such that half of the material including exterior and interior surfaces 327 and 329 form a cover 328 and the other half of the material including exterior and interior surfaces 327 and 329 form a back 330. Cover 328 is defined by fold 332 and a plurality of free edges including a side edge 334 opposing the fold 332, a bottom edge 336 and a top edge 338. Bottom 330 is defined by fold 332 and a plurality of free edges including a side edge 340 opposing the fold 332, a bottom edge 342 and a top edge 344.

Sleeping bag 304 includes a fastener 346 for detachably connecting at least one of the free edges of both cover 328 and back 330 to form a bag structure for a person to lie in. In FIG. 17, a first portion of fastener 346 is located along side edge 334 and bottom edge 336 and a second portion of fastener 346 is located along side edge 340 and bottom edge 342. Fastener 346 includes a slide 353 and fastener pull 347 coupled to the slide 353. For example and as illustrated in FIG. 17, fastener 346 can be a zipper 346 having slide 353 and zipper pull 347. In such an embodiment, first portion of fastener 346 is a row of plurality of first teeth and the second portion of fastener 346 is a row of a plurality of second teeth. Slide 353 moves along the rows of teeth and meshes together or separates the opposing rows of teeth depending on the direction slide 353 is moved.

While the interior and exterior surfaces 327 and 329 of sleeping bag 304 can be made of the same or different material, sleeping bag 304 may, but not always include a first type of pattern on the interior of the sleeping bag and a second type of pattern on the exterior of the sleeping bag. For example and as illustrated in FIG. 17, the interior of sleeping bag 304 includes a printed first design 348 and the exterior of the sleeping bag 304 includes a heat embossed second design 350. In particular, first design 348 includes a printed tree design and second design 350 includes a heat embossed wood grain design.

Figure 18:
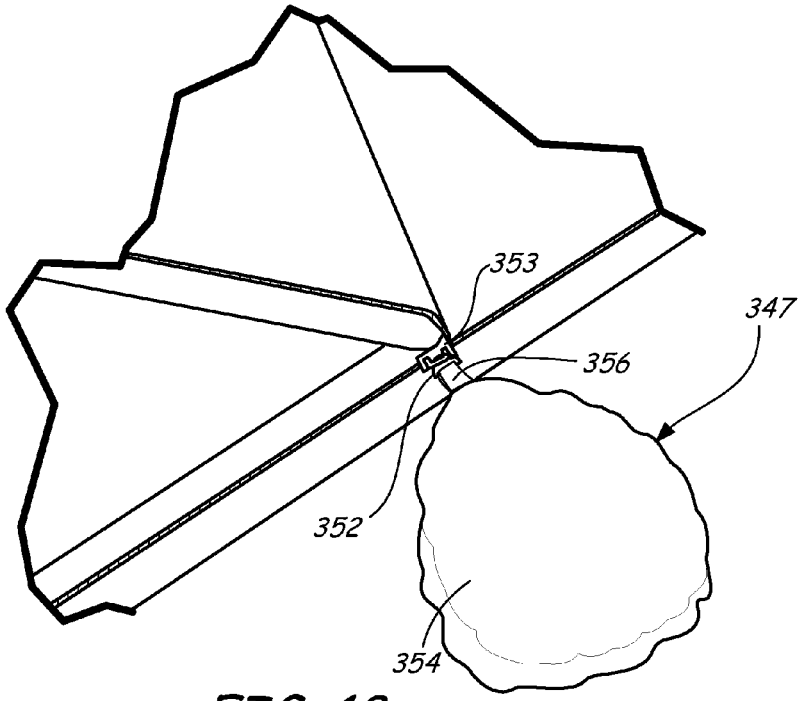
FIG. 18 is an enlarged view of a zipper pull on the sleeping bag illustrated in FIG. 17.

FIG. 18 illustrates an enlarged detailed view of fastener pull 347 under one embodiment. Fastener pull 347 includes a ring portion 352 attached to slide 353 and a pull portion 354 attached to ring portion 352. A tab portion 356 is connected to pull portion 354, passes through the center of ring portion 352 and is stitched together so as to form a closed loop around ring portion 352. Pull portion 354 is in the form of an animal tail that corresponds to and/or matches the decorative animal head on the exterior surface 305 of first end 306 of the corresponding sack 302. For example and as illustrated in FIGS. 15 and 16, pull portion 354 is a bear tail. It should be realized that the terminology "animal tail" does not mean that pull portion 354 includes features of a real animal tail. Rather, "animal tail" contemplates an ornamental or decorative object that simulates characteristics of an animal tail. To open the sleeping bag 304 for use, the fastener 346 is unfastened by tugging on the animal tail or pull portion 354, which effectively moves slide 353 in a direction away from the top of sleeping bag 304. Likewise, to shut sleeping bag 304, the fastener 346 is fastened shut by tugging on the animal tail or pull portion 354, which effectively moves slide 353 in a direction toward the top of sleeping bag 304.

Sleeping bag 304 can be stuffed, rolled or folded for storing in sack 302. For example, sleep system 300 can include straps made of hook and loop, such as Velcro®, for wrapping and securing around the rolled or folded sleeping bag 304 before inserting the rolled or folded sleeping bag 304 into sack 302. Although the ring portion 352 and pull portion 354 of fastener pull 347 are parts of sleeping bag 304, after sleeping bag 304 is stuffed, rolled or folded and placed into sack 302 for storage as illustrated in FIGS. 15-16, the animal tail 354 is pulled through opening 312 to extend outwardly from sack 302. When drawcord 316 is tightened as illustrated in FIG. 16, animal tail 354 remains extended from exterior surface 305 of sack 302 such that the sack holding the sleeping bag resembles the body and shape of an animal.

Although the present invention has been described with reference to preferred embodiments, workers skilled in the art will recognize that changes may be made in form and detail without departing from the spirit and scope of the invention. For example, other types of animal heads can be used on a sack and other types of corresponding animal tails can be used as fastener pulls on a sleeping bag, such as squirrel heads and squirrel tails, deer heads and deer tails and beaver head and beaver tails.

What is claimed is:

1. A sleep system comprising:

a sack having an exterior surface, an interior surface, a closed end and an open end, the exterior surface of the closed end including decorative features of an animal head, wherein the open end comprises an edge having a drawcord tunnel which houses a drawcord, the drawcord configured to cinch the open end at least partially closed; and a sleeping bag configured to be stored in the sack when not in use and comprising:

a fastener detachably connecting two free edges of the sleeping bag and including a fastener pull, the fastener pull having an animal tail corresponding with the animal head located on the exterior surface of the closed end of the sack, wherein the animal tail of the fastener pull extends outwardly from the exterior surface of the sack and through the open end when the sleeping bag is stored in the sack and the drawcord cinches the open end at least partially closed.

2. The sleep system of claim 1, wherein the sack further comprises a plurality of decorative animal feet located along the exterior surface of the sack between the closed end and the open end, the decorative animal feet coupled to the sack and extending outwardly from the exterior surface of the sack.

3. The sleep system of claim 1, wherein the closed end of the sack further comprises a perimeter, wherein portions of the decorative features of the animal head are located within the perimeter of the closed end and portions of the decorative features of the animal head are coupled to the closed end and extend outwardly from the perimeter.

4. The sleep system of claim 3, wherein the portions of the decorative features of the animal head extending outwardly from the perimeter of the closed end comprise animal ears.

5. The sleep system of claim 3, wherein the portions of the decorative features located within the perimeter of the closed end are printed on the closed end of the sack.

6. The sleep system of claim 3, wherein the portions of the decorative features located within the perimeter of the closed end are heat embossed on the closed end of the sack.

7. The sleep system of claim 1, wherein the animal head and the animal tail comprise a bear head and a bear tail.

8. The sleep system of claim 1, wherein the animal head and the animal tail comprise a rabbit head and a rabbit tail.

9. The sleep system of claim 1, wherein the fastener comprises a zipper.

10. The sleep system of claim 1, wherein the animal head and the animal tail comprise a fox head and a fox tail.

11. A method of storing a sleeping bag comprising:

inserting a sleeping bag into a sack, the sleeping bag comprising a fastener pull having an animal tail and the sack having an exterior surface including a closed end and a open end, the exterior surface of the closed end including decorative features of an animal head that correspond with the animal tail of the fastener pull;

pulling the animal tail of the fastener pull through the open end of the sack; and at least partially closing the open end of the sack such that the animal tail extends outwardly from the exterior surface of the sack, wherein closing the open end of the sack comprises cinching the open end of the sack using a drawcord threaded through a drawcord tunnel along the edge of the open end.

12. The method of claim 11, further comprising printing the decorative features of the animal head on the closed end of the sack.

13. The method of claim 11, further comprising heat embossing the decorative features of the animal head on the closed end of the sack.

14. A sleep system comprising:

a sack having an exterior surface, an interior surface, a first end and a second end, the exterior surface of the first end including decorative features of an animal head and the second end including an opening with an edge having a drawcord tunnel which houses a drawcord, the drawcord configured to cinch the opening at least partially closed; and a sleeping bag stored in the sack when not in use and including a zipper having a zipper pull, the zipper pull comprising an animal tail corresponding with the animal head located on the exterior surface of the first end of the sack, the animal tail extending through the opening in the second end and outwardly from the exterior surface of the sack.

15. The sleep system of claim 14, wherein the sack further comprises a plurality of decorative animal feet located along the exterior surface of the sack between the first end and the second end, the decorative animal feet coupled to the sack and extending outwardly from the exterior surface of the sack.

16. The sleep system of claim 14, wherein the first end of the sack further comprises a perimeter, portions of the decorative features of the animal head being located within the perimeter of the first end and portions of the decorative features of the animal head being coupled to the first end and extending outwardly from the perimeter.

17. The sleep system of claim 16, wherein the portions of the decorative features of the animal head extending outwardly from the perimeter of the first end comprise animal ears.

* * * * *